US007360725B2

(12) United States Patent
Johnson et al.

(10) Patent No.: US 7,360,725 B2
(45) Date of Patent: Apr. 22, 2008

(54) MATERIAL CRUSHER

(75) Inventors: George Franklin Johnson, Pikeville, KY (US); Arnemann Rolf Grender, Pippa Passes, KY (US)

(73) Assignee: Johnson Industries, Inc., Pikeville, KY (US)

( * ) Notice: Subject to any disclaimer, the term of this patent is extended or adjusted under 35 U.S.C. 154(b) by 189 days.

(21) Appl. No.: 11/216,653

(22) Filed: Aug. 31, 2005

(65) Prior Publication Data

US 2006/0055186 A1 Mar. 16, 2006

Related U.S. Application Data

(60) Provisional application No. 60/605,685, filed on Aug. 31, 2004.

(51) Int. Cl.
*B02C 13/284* (2006.01)

(52) U.S. Cl. ..... 241/27; 241/73; 241/189.1; 241/285.3

(58) Field of Classification Search ..... 241/285.3, 241/185.5–197, 73, 27, 30
See application file for complete search history.

(56) References Cited

U.S. PATENT DOCUMENTS 1,427,842 A * 9/1922 Plaisted ..... 241/82
1,930,623 A * 10/1933 Peterson ..... 241/89
2,076,025 A 4/1937 Hazle, Jr.
2,098,480 A * 11/1937 Ammon ..... 241/51
3,088,683 A * 5/1963 Joseph et al. ..... 241/88.2
3,196,915 A 7/1965 Bryant
3,608,841 A * 9/1971 Wageneder ..... 241/189.1
3,756,519 A 9/1973 Reynolds et al.
4,008,857 A 2/1977 Schutte
4,373,678 A * 2/1983 Reitter ..... 241/189.1
5,472,147 A 12/1995 Doppstadt
5,484,110 A 1/1996 Doppstadt
5,718,389 A 2/1998 Finken et al.
5,743,472 A * 4/1998 Williams et al. ..... 241/32
5,921,483 A 7/1999 Folling et al.
6,745,966 B2 6/2004 Heukamp
7,222,805 B1 * 5/2007 Williams, Jr. ..... 241/89.1

FOREIGN PATENT DOCUMENTS

DE 4312509 10/1994

OTHER PUBLICATIONS

U.S. Appl. No. 10/096,888, filed Oct. 3, 2002, Heukamp.

* cited by examiner

*Primary Examiner*—Mark Rosenbaum
(74) *Attorney, Agent, or Firm*—Frost Brown Todd LLC

(57) ABSTRACT

Crusher has a housing with a cylindrical crushing chamber defined by a tubular wall. Opposed side plates are secured to respective ends of the wall. A drive shaft rotates impact tools within the chamber. An intake aperture and a discharge aperture are in communication with the chamber. An inlet door, having an inner face with a curvature of similar radius to the cylindrical chamber, may be pivoted over the intake aperture such that the inner face is flush with the inner surface of the chamber, whereby impact tools strike and remove material adhering to the inner face. An arcuately shaped screen, having a curvature of similar radius to the cylindrical chamber, may be pivoted over the discharge aperture such that the screen is flush with the inner surface of the chamber. The screen may be pivoted away from the discharge aperture for the service thereof.

8 Claims, 2 Drawing Sheets

MATERIAL CRUSHER

This application claims the benefit of United States Provisional Patent Application entitled "Self Cleaning Granular Materials Crusher", U.S. Application Ser. No. 60/605,685 filed on Aug. 31, 2004.

BACKGROUND OF THE INVENTION

Material crushers are generally used to crush and reduce the size of material and are employed in a variety of fields, including but not limited to, mining, ceramics, recycling, iron and steel industries, etc. These material crushers may be used as primary crushers or as secondary or tertiary crushers in the processing of material requiring reduced size. The prior art fails to teach or suggest a crusher or method of the present invention.

BRIEF DESCRIPTION OF THE DRAWINGS

While the specification concludes with claims which particularly point out and distinctly claim the invention, it is believed the present invention will be better understood from the following accompanying drawings, in which like reference numerals identify the same elements and which:

DETAILED DESCRIPTION OF THE INVENTION

Figure 2:
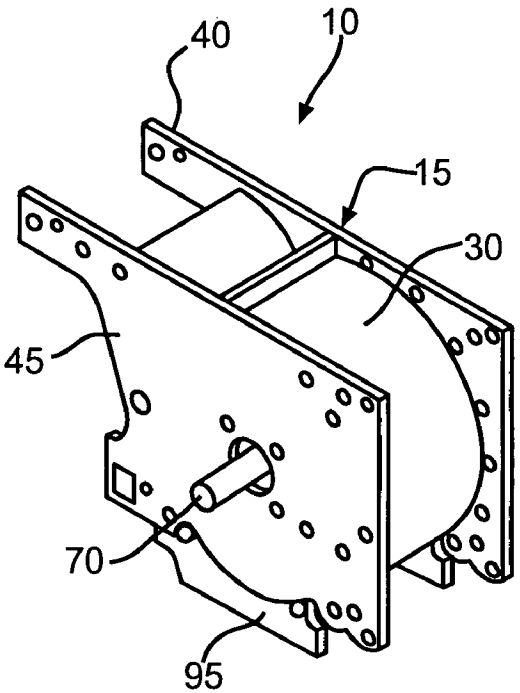
FIG. 2 depicts a second perspective view of the crusher of FIG. 1.
Figure 1:
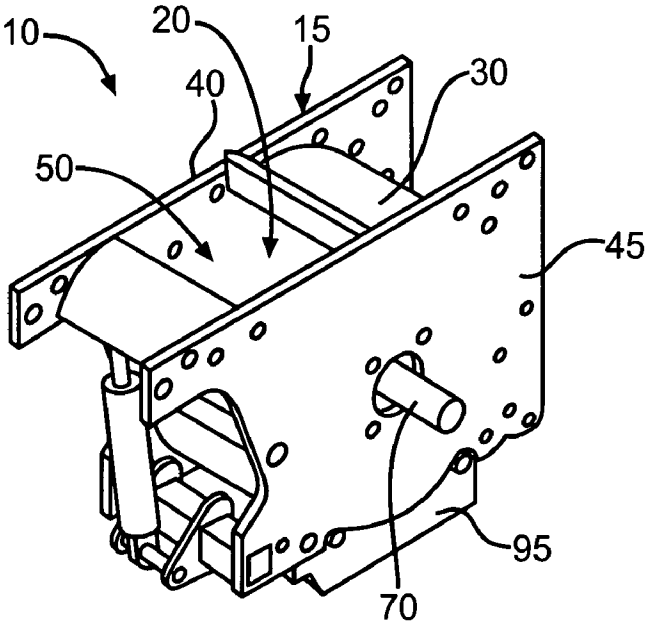
FIG. 1 depicts a perspective view of the crusher of the present invention.

Referring now to FIGS. 1-6, the crusher 10 comprises a housing 15 having a substantially cylindrical crushing chamber 20. The crushing chamber 20 comprises and is defined by a substantially tubular wall 30 having an inner circumferential surface 35. The inner diameter of the chamber 20 may be between about 10 inches to 30 inches, more preferably about between 15 inches and 20 inches, and even more preferably about 16½ inches. While the chamber 20 and tubular wall 30 are shown as substantially tubular or cylindrical in shape and as having substantially circular cross-sections, it should be appreciated that the chamber 20 and wall 30 may be of any shape or cross-section suitable for receiving material to be crushed and containing such material until the material is reduced to a desired size. For example, the chamber and wall may have oval cross-sections. The chamber 20 may also include impact elements known in the art to assist in the crushing of material, such as breaker bars, breaker plates, impact aprons, and the like. Such impact elements may be integral or coupled to the inner circumferential surface 35 and/or one or both side plates 40, 45.

A first side plate 40 and a second side plate 45 may each be attached to corresponding end of the wall 30, by welding, mechanical fasteners, a high strength epoxy or the like. The side plates 40, 45 may be arranged to be substantially parallel to one another and preferably substantially perpendicular to the longitudinal axis of the chamber 20. The side plates 40, 45 are preferably between about 5 inches and 15 inches apart, and more preferable about 9¼ inches apart. The wall 30 and side plates 40, 45 may be of any suitably durable material known in the art, such as iron, steel, or the like.

Figure 4:
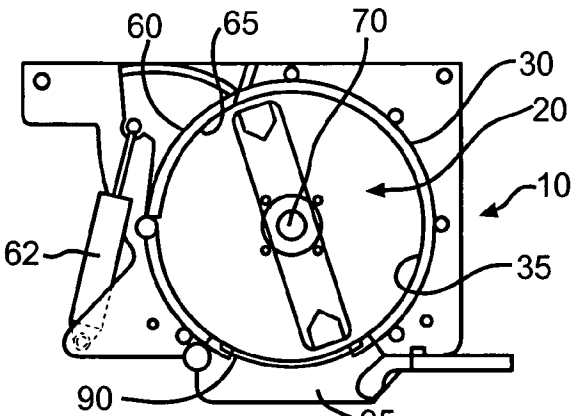
FIG. 4 is a schematic side elevational view of the crusher with the inlet door pivoted over the intake aperture.
Figure 3:
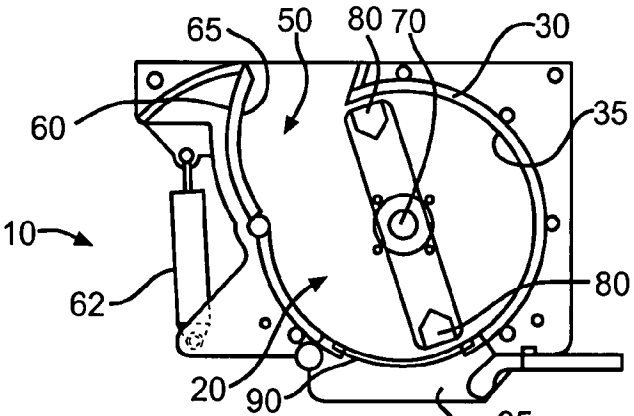
FIG. 3 is a schematic side elevational view of the crusher with the inlet door pivoted away from the intake aperture.

The wall 30 may also include an intake aperture 50 therein for receiving material to be crushed into the chamber 20 for crushing. The intake aperture 50 may be of any dimension known in the art and suitable for receiving uncrushed material into the chamber 20. An inlet door 60 may pivot between a position away from the intake aperture 50, as shown in FIG. 3, and a position over the intake aperture 50, as shown in FIG. 4. The inlet door 60 may be pivotally secured to the wall 30 by way of one or more hinge assemblies. Alternatively, the inlet door 60 may pivot about a bar extending between one or both side plates 40, 45. The inlet door 60 may be of any suitably durable material known in the art, such as iron, steel, or the like. The inlet door 60 may be pivoted by a double acting piston assembly 62 preferably mounted on the housing 15. Alternatively, the inlet door 60 may be pivoted by a motor, such as an electric motor or the like, or manually by an operator.

The inlet door 60 preferably includes an arcuate inner face 65. The curvature of the arcuate inner face 65 preferably has a radius similar to the radius of inner circumferential surface 35 such that when the inlet door 60 is in a position over the intake aperture 50, the arcuate inner face 65 is substantially flush with the inner circumferential surface 35 of the chamber 20. Also, when the inlet door 60 is in a position away from the intake aperture 50, this configuration advantageously provides for the guiding of material by the inner face 65 towards the intake aperture 50.

One or both of the side plates 40, 45 may rotationally support a rotary drive shaft 70 extending into the chamber 20. In one embodiment, a portion of the drive shaft 70 within the chamber 20 may be substantially coaxial with the longitudinal axis of the chamber 20. The rotary drive shaft 70 may be driven by any suitable drive mechanism known in the art, such as an electronic motor, a gas engine, or the like.

One or more impact tools 80 may be secured to the drive shaft 70 within the chamber 20. The impact tools 80 may be of any type known in the art suitable for impacting and crushing the desired material, such as, hammers, chains, blow bars, or the like. The rotary drive shaft 70 may rotate the tools 80 along a path of travel substantially concentric with the inner circumferential surface 35 of the chamber 20. The tools 80 are preferably arranged on the drive shaft 70 such that there is clearance between the end of each tool 70 and the inner circumferential surface 35 of up to about ½ inch and preferably about ⅛ inch.

In use, the inlet door 60 may initially be positioned away from the intake aperture 50. Material to be crushed may be directed towards the intake aperture 50 and into the chamber 20. At least a portion of such material may contact the inner face 65 of the inlet door 60 thereby being guided towards the intake aperture 50. Over time, material may adhere to and build up on the inner face 65 such that the intake aperture 50 may be partially to fully blocked thereby. When such build up occurs, the inlet door 60 may be pivoted to a position above the intake aperture 50 such that the inner face 65 of the inlet door 60 is substantially flush with the inner surface 35 of the chamber 20 such that the impact tools 80 may strike the adhered material and remove such material from the inner face 65 whereby the material then enters the chamber 20 to be crushed.

The inlet door 60 may be pivoted over the intake aperture 50 by an operator when the operator observes a build up. Alternatively, the inlet door 60 may be pivoted over the intake aperture 50 automatically at regular time intervals. The inlet door 60 may be positioned over the intake aperture 50 for up to about 30 seconds, more preferably about 10 seconds, and even more preferably about 1 second; after which, the inlet door 60 may be automatically pivoted away from the intake aperture 50. Alternatively, the inlet door 60 may be pivoted over the intake aperture 50 and subsequently pivoted away at the discretion of an operator. Additionally, the flow of material to the crusher 10 may be temporarily ceased when the inlet door 60 is over the intake aperture 50 and the flow of material resumed when the inlet door 60 is pivoted away from the intake aperture 50.

Figure 6:
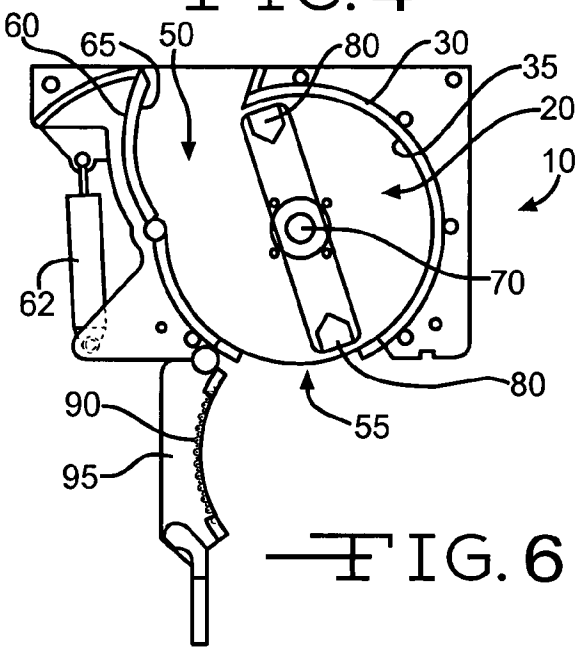
FIG. 6 is a schematic side elevational view of the crusher with the screen pivoted away from the discharge aperture.
Figure 5:
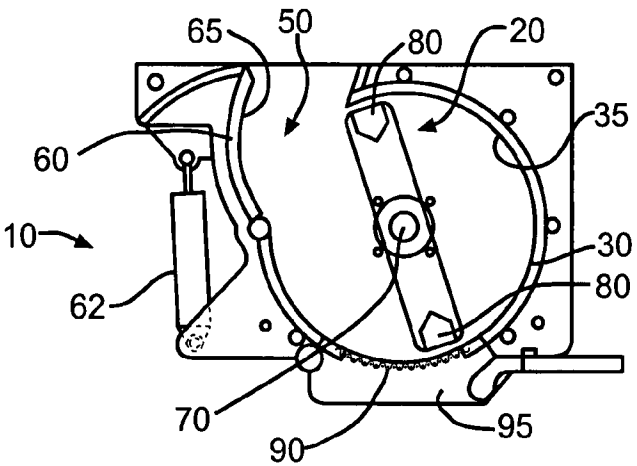
FIG. 5 is a schematic side elevational view of the crusher with the screen pivoted over the discharge aperture.

The tubular wall 30 may also include a discharge aperture 55 therein for discharging crushed material from the chamber 20. An arcuately shaped screen 90 may pivot between a position over the discharge aperture 55 where the reduced or crushed material mall fall through the screen 90, as shown in FIG. 5, and a position away from the discharge aperture 55, as shown in FIG. 6.

The screen 90 may be pivotally secured to the wall 30 by way of one or more hinge assemblies. Alternatively, the screen 90 may pivot about a bar extending between one or both side plates 40, 45. Also, in one embodiment, the screen is secured to a frame 95 which may be pivotally secured to the wall 30 and/or one or both side plates 40, 45. The curvature of the screen 90 may have a radius similar to the radius of inner circumferential surface 35 such that when the screen 90 is in a position over the discharge aperture 55, the screen 90 is substantially flush with the inner circumferential surface 35 of the chamber 20. The screen 90 and/or frame 95 may be secured to the wall 30 and/or one or more side plates 40, 45 during operation of the crusher 10 by mechanical fasteners and the like. For service or replacement of the screen 90, the screen 90 and/or frame 95 may be pivoted away from the discharge aperture 55 thereby providing an operator easy access to repair, replace or otherwise service the screen 90.

The screen 90 may be any suitable screen known in the art. The screen 90 may be pivoted manually by an operator, or by a mechanism such as double acting piston assembly, a motor, such as an electric motor, or the like.

While the present invention has been illustrated by the description of several embodiments and while the illustrative embodiments have been described in considerable detail, it is not the intention of the applicant to restrict or in any way limit the scope of the appended claims to such detail. Additional advantages and modifications may readily appear to those skilled in the art.

What we claim is:

1. A crusher for crushing material comprising:

(a) a housing, said housing comprising:

(i) a substantially cylindrical crushing chamber comprising and being defined by a substantially tubular wall having an inner circumferential surface;

(ii) first and second opposed side plates, each of said first and second side plates being attached to a corresponding end of said substantially tubular wall, said first and second side plates being substantially perpendicular to the longitudinal axis of said tubular wall;

(iii) an intake aperture in said tubular wall, said intake aperture being in communication with said cylindrical chamber;

(iv) a discharge aperture in said tubular wall, said discharge aperture being in communication with said cylindrical chamber; and (v) an inlet door having an arcuate inner face, said inlet door pivotally secured to said wall, said arcuate inner face having a curvature of substantially similar radius of said inner circumferential surface of said cylindrical chamber, wherein said inlet door may be selectively pivoted between a first position away from said intake aperture and a second position over said intake aperture such that when said inlet door is pivoted to said first position away from said intake aperture said arcuate inner face of said inlet door may guide material towards said intake aperture, and such that when said inlet door is pivoted to said second position over said intake aperture said arcuate inner face is substantially flush with said inner circumferential surface of said cylindrical chamber;

(b) a rotary drive shaft supported by at least one of said side plates such that at least a portion of said drive shaft is disposed within said cylindrical chamber wherein said at least a portion of said drive shaft is disposed within said cylindrical chamber substantially coaxially with said longitudinal axis of said cylindrical chamber; and (c) one or more impact tools for crushing received material, each said impact tool being coupled to said at least a portion of said rotary drive shaft disposed within said cylindrical chamber, each said impact tool further being arranged for rotary movement by said rotary drive shaft along a path of travel substantially concentric with said inner circumferential surface of said cylindrical chamber;

wherein when said inlet door is pivoted to said second position over said intake aperture, said one or more impact tools may impact material adhering to said arcuate inner face of said inlet door thereby removing said adhered material from said arcuate inner face and into said chamber.

2. The crusher of claim 1 further comprising an arcuately shaped screen pivotally secured to said wall, said arcuately shaped screen having a curvature of substantially similar radius of said inner circumferential surface of said cylindrical chamber, wherein said screen may be selectively pivoted between a first position over said discharge aperture and a second position away from said discharge aperture, such that when said screen is pivoted to said first position over said discharge aperture said screen is substantially flush with said inner circumferential surface of said cylindrical chamber, and such that when said screen is pivoted to said second position away from said discharge aperture said screen may be accessible for service.

3. A crusher for crushing material comprising:

(a) a housing, said housing comprising:

(i) a substantially cylindrical crushing chamber comprising and being defined by a substantially tubular wall having an inner circumferential surface;

(ii) first and second opposed side plates, each of said first and second side plates being attached to a corresponding end of said substantially tubular wall, said first and second side plates being substantially perpendicular to the longitudinal axis of said tubular wall;

(iii) an intake aperture in said tubular wall, said intake aperture being in communication with said cylindrical chamber;

(iv) a discharge aperture in said tubular wall, said discharge aperture being in communication with said cylindrical chamber;

(v) an inlet door having an arcuate inner face, said inlet door pivotally secured to said wall, said arcuate inner face having a curvature of substantially similar radius of said inner circumferential surface of said cylindrical chamber, wherein said inlet door may be selectively pivoted between a first position away from said intake aperture and a second position over said intake aperture such that when said inlet door is pivoted to said first position away from said intake aperture said arcuate inner face of said inlet door may guide material towards said intake aperture, and such that when said inlet door is pivoted to said second position over said intake aperture said arcuate inner face is substantially flush with said inner circumferential surface of said cylindrical chamber; and (vi) an arcuately shaped screen pivotally secured to said wall, said arcuately shaped screen having a curvature of substantially similar radius of said inner circumferential surface of said cylindrical chamber, wherein said screen may be selectively pivoted between a first position over said discharge aperture and a second position away from said discharge aperture, such that when said screen is pivoted to said first position over said discharge aperture said screen is substantially flush with said inner circumferential surface of said cylindrical chamber, and such that when said screen is pivoted to said second position away from said discharge aperture said screen may be accessible for service;

(b) a rotary drive shaft supported by at least one of said side plates such that at least a portion of said drive shaft is disposed within said cylindrical chamber wherein said at least a portion of said drive shaft is disposed within said cylindrical chamber substantially coaxially with said longitudinal axis of said cylindrical chamber; and (c) one or more impact tools for crushing received material, each said impact tool being coupled to said at least a portion of said rotary drive shaft disposed within said cylindrical chamber, each said impact tool further being arranged for rotary movement by said rotary drive shaft along a path of travel substantially concentric with said inner circumferential surface of said cylindrical chamber;

wherein when said inlet door is pivoted to said second position over said intake aperture, said one or more impact tools may impact material adhering to said arcuate inner face of said inlet door thereby removing said adhered material from said arcuate inner face and into said chamber.

4. A method of crushing material comprising the steps of:

(a) providing a crusher comprising:

(i) a housing, said housing comprising:

(1) a substantially cylindrical crushing chamber comprising and being defined by a substantially tubular wall having an inner circumferential surface;

(2) first and second opposed side plates, each of said first and second side plates being attached to a corresponding end of said substantially tubular wall, said first and second side plates being substantially perpendicular to the longitudinal axis of said tubular wall;

(3) an intake aperture in said tubular wall, said intake aperture being in communication with said cylindrical chamber;

(4) a discharge aperture in said tubular wall, said discharge aperture being in communication with said cylindrical chamber;

(5) an inlet door having an arcuate inner face, said inlet door pivotally secured to said wall, said arcuate inner face having a curvature of substantially similar radius of said inner circumferential surface of said cylindrical chamber, wherein said inlet door may be selectively pivoted between a first position away from said intake aperture and a second position over said intake aperture such that when said inlet door is pivoted to said first position away ftom said intake aperture said arcuate inner face of said inlet door may guide material towards said intake aperture, and such that when said inlet door is pivoted to said second position over said intake aperture said arcuate inner face is substantially flush with said inner circumferential surface of said cylindrical chamber; and (6) an arcuately shaped screen pivotally secured to said wall, said arcuately shaped screen having a curvature of substantially similar radius of said inner circumferential surface of said cylindrical chamber, wherein said screen may be selectively pivoted between a first position over said discharge aperture and a second position away from said discharge aperture, such that when said screen is pivoted to said first position over said discharge aperture said screen is substantially flush with said inner circumferential surface of said cylindrical chamber, and such that when said screen is pivoted to said second position away from said discharge aperture said screen may be accessible for service;

(ii) a rotary drive shaft supported by at least one of said side plates such that at least a portion of said drive shaft is disposed within said cylindrical chamber wherein said at least a portion of said drive shaft is disposed within said cylindrical chamber substantially coaxially with said longitudinal axis of said cylindrical chamber; and (iii) one or more impact tools for crushing received material, each said impact tool being coupled to said at least a portion of said rotary drive shaft disposed within said cylindrical chamber, each said impact tool further being arranged for rotary movement by said rotary drive shaft along a path of travel substantially concentric with said inner circumferential surface of said cylindrical chamber;

wherein when said inlet door is pivoted to said second position over said intake aperture, said one or more impact tools may impact material adhering to said arcuate inner face of said inlet door thereby removing said adhered material from said arcuate inner face and into said chamber;

(b) pivoting the inlet door into the first position and pouring material through the intake aperture into the chamber, thereby enabling the one or more impact tools to contact the material;

(c) pivoting the screen into the first position such that the material may pass through the screen after being contacted by the one or more impact tools;

(d) stopping the flow of material through the intake aperture;

(e) pivoting the inlet door into the second position, thereby enabling the one or more impact tools to impact material adhering to the arcuate inner face of the inlet door thereby removing the adhered material from the arcuate inner face and into the chamber.

5. The process of claim 4, wherein the step of pivoting the inlet door into the second position is accomplished manually.

6. The process of claim 4, wherein the step of pivoting the inlet door into the second position is accomplished mechanically.

7. The process of claim 6, wherein the step of pivoting the inlet door into the second position is accomplished using a double acting piston assembly or a motor.

8. The process of claim 7, wherein the motor is an electric motor.

* * * * *